United States Patent [19]

Voss et al.

[11] Patent Number: 4,917,167

[45] Date of Patent: Apr. 17, 1990

[54] SKYLIGHT WINDOW COVERING AND CONTROL MEANS THEREFOR

[75] Inventors: Robert J. Voss, Fountain Valley; Louis G. Valle, Huntington Beach, both of Calif.

[73] Assignee: Home Fashions, Inc., Westminster, Calif.

[21] Appl. No.: 328,016

[22] Filed: Mar. 23, 1989

[51] Int. Cl.[4] ..... E06B 9/262

[52] U.S. Cl. ..... 160/84.1; 160/107

[58] Field of Search ..... 160/84.1, 168.1, 172, 160/107

[56] References Cited

U.S. PATENT DOCUMENTS 4,552,196 11/1985 Vechiarelli ..... 160/172 X
4,593,737 6/1986 Clemente ..... 160/84.1
4,723,464 9/1988 Kobayashi ..... 160/168.1
4,762,160 8/1988 Bechtold et al. ..... 160/98

*Primary Examiner*—Blair M. Johnson
*Attorney, Agent, or Firm*—George J. Netter

[57] ABSTRACT

A skylight window covering has a frame affixed to the room vertical or ceiling walls with a central opening lying opposite the skylight. A length of pleated fabric has one end secured to the frame and an opposite end held by a movable rail with ends sliding along the frame. A helically grooved rod has its ends journaled at one end to a 90° gear box and is threaded within a nut on the end of the movable rail such that rod rotation adjustably positions the rail and pleated fabric. Resilient supports prevent the rod from drooping and are temporarily moved aside as the rail moves therepast and immediately spring back to supporting position. Adjustment driving of the rod can be accomplished manually or by a handheld electric motor.

8 Claims, 4 Drawing Sheets

SKYLIGHT WINDOW COVERING AND CONTROL MEANS THEREFOR

FIELD OF THE INVENTION

The present invention relates generally to window coverings, and, more particularly, to a window covering for a skylight or window located in a ceiling wall.

BACKGROUND OF THE INVENTION

A well-received window covering at the present time consists of an extent of pleated fabric which can be expanded to cover a window, for example, and also withdrawn folding upon itself along the pleat lines to leave the window unobstructed. Such window covering units for a window in a vertical wall typically have one or more cords which pass through aligned openings in the pleated fabric and can be manipulated to raise or lower a rail at one end to adjust the window covering and move it from closed to open or to any intermediate position desired.

Where the window to be adjustably covered by a window covering unit is on a vertical wall and not too far above the ground plane, access in the usual case does not pose great difficulty. However, in the case of a ceiling window or skylight, several difficulties immediately present themselves. First of all, the window covering unit is at some distance from the ground level or room floor and requires special apparatus for long range adjustment for correct operation. In addition, the window covering unit moves in a horizontal plane rather than vertically as in the case of a vertical wall window, for example, and therefore must be driven to its various adjustment positions without the aid of gravity. A still further source of possible difficulty is that the window covering unit must be carefully constructed so as not to become easily jammed and, in fact, should be substantially fool-proof in this regard. That is, whereas a window covering unit closely adjacent the floor can be easily reached for manipulative release of a jam, where it is located on the ceiling this becomes manifestly more difficult requiring step ladders or the like and presenting some danger of falling to an individual attempting repair.

SUMMARY OF THE INVENTION

In accordance with the present invention there is provided a skylight window covering unit consisting generally of a length of pleated fabric contained within a frame mounted directly to the inside wall surfaces in generally covering relation to the skylight. The pleated fabric has one end affixed to the frame and its opposite end affixed to a rail which is guided for movement by an elongated helically threaded member. A plurality of support filaments pass through aligned openings in the pleated fabric central portion and serve to support the fabric in a generally flat planar relation with respect to the support frame.

The helically threaded drive member has its ends rotatably journaled in internal corners along one side of the frame. At one end a gear mechanism has an opening for receiving the end of a wand which can be selectively rotated to produce a corresponding rotation in the helically threaded drive member. This rotation acts to move the window covering rail, and thus the pleated fabric, in a desired direction to either cover or uncover the skylight. Optionally, the wand can be powered by a battery operated motor.

The helically threaded drive member is positioned between a pair of flexible guides which can be moved out of the way when the rail moves therepast and yet maintain vertical support of the helical member so that it does not hang downwardly to destroy aesthetics of the window covering unit and possibly result in improper operation.

DESCRIPTION OF A PREFERRED EMBODIMENT

Figure 1:
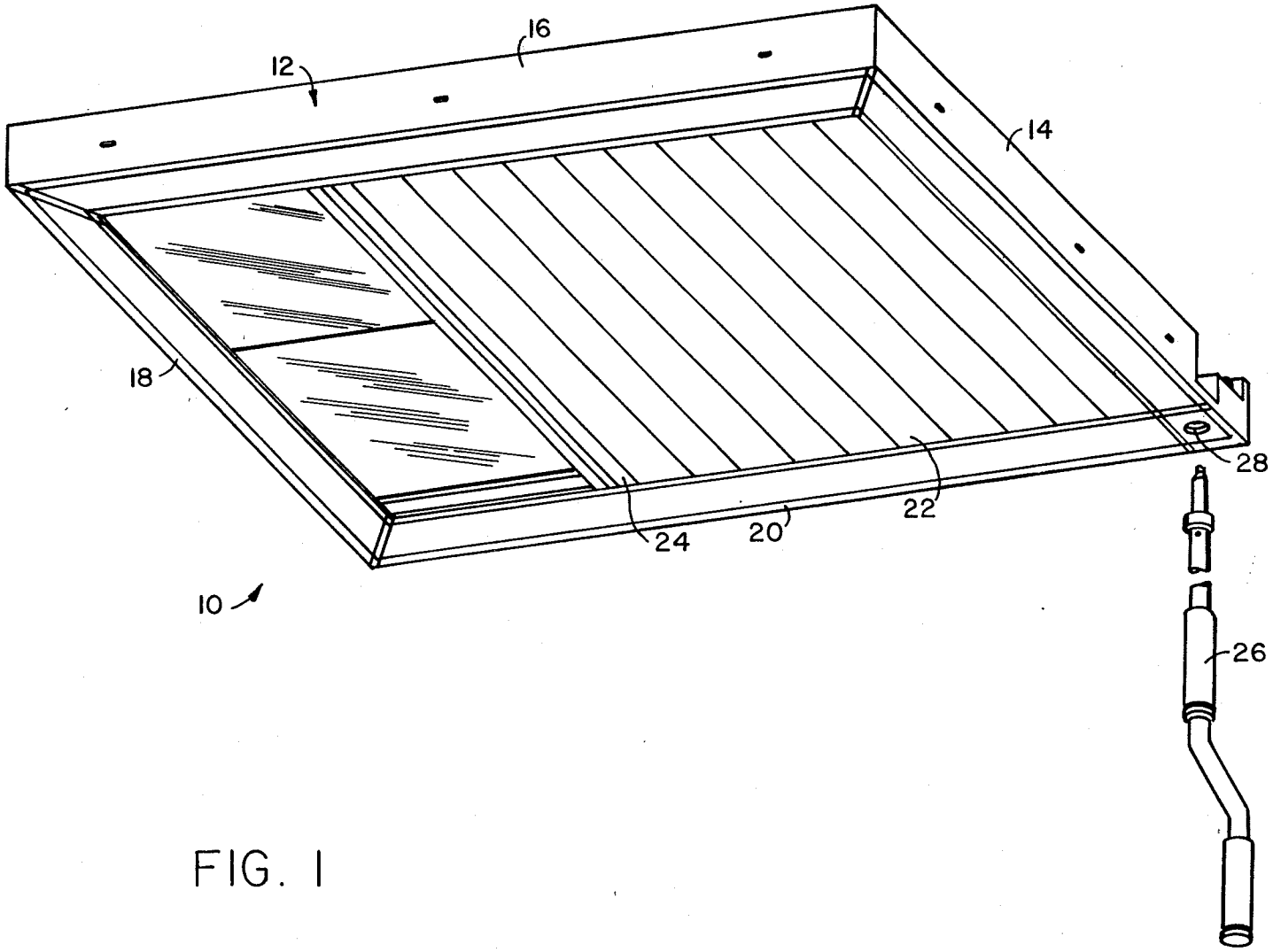
FIG. 1 is a perspective view of a window covering unit of the present invention in its normal use mounting.

Turning now to the drawings and particularly FIG. 1, the window covering unit to be described is enumerated generally as 10 and includes a frame 12 having two end members 14 and 18 and two side members 16 and 20, all of which are edge interconnected to enclose a central open space. The frame side members are adapted to be mounted directly to the vertical wall surfaces and/or the ceiling, the latter including the skylight to be covered by the window covering unit. An extent of a pleated fabric 22 has one end fixedly secured within the member 14 and an opposite end secured to a rail 24 mounted in the frame 12. The rail and pleated fabric can be selectively positioned by a wand 26 which has an end received within a drive opening 28. The dimensions of the frame 12 are such that they will completely cover the skylight and not leave any lines of light on either side or end.

Figure 2:
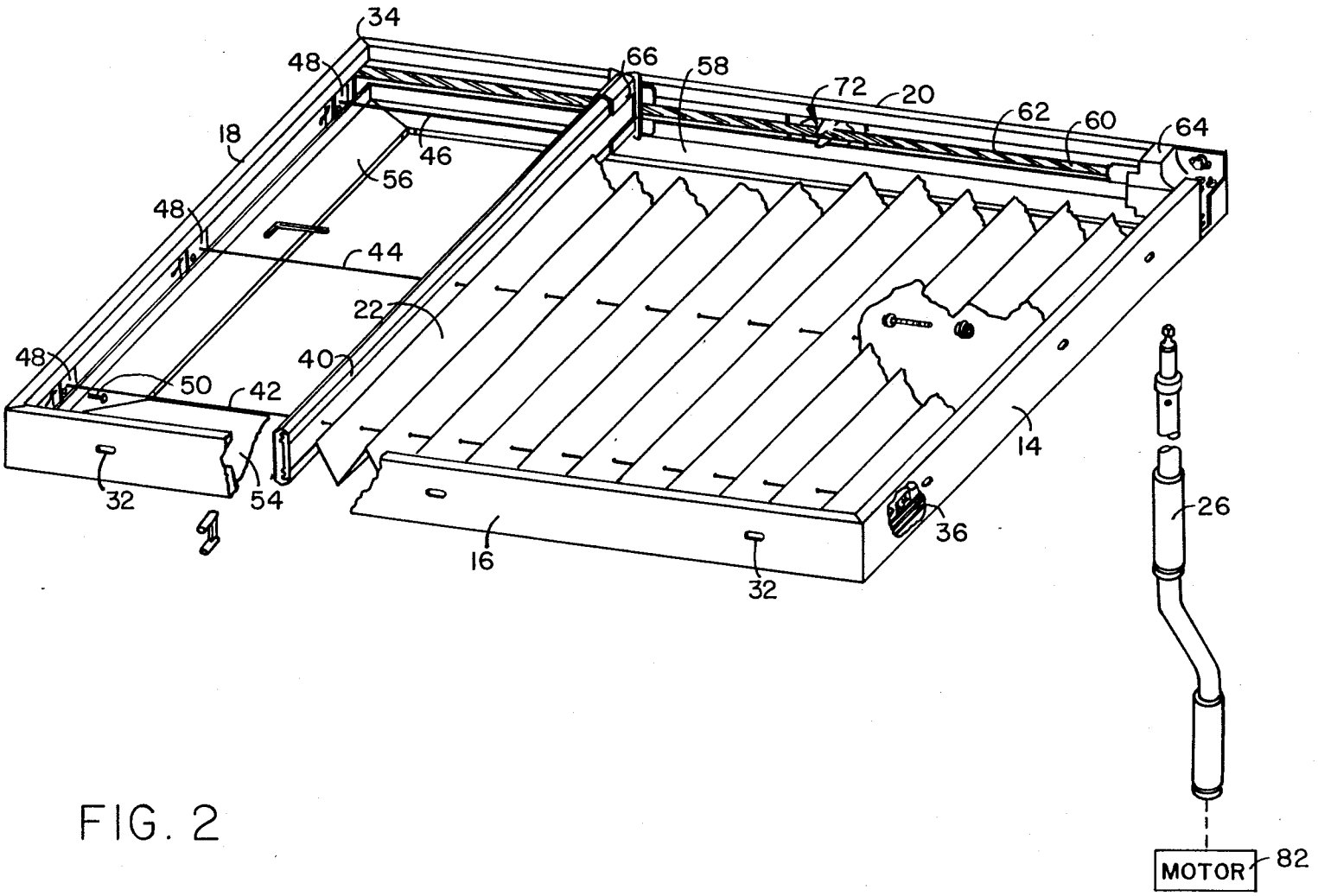
FIG. 2 is a further perspective view of the window covering unit of FIG. 1 showing its various parts in assembly.
Figure 3:
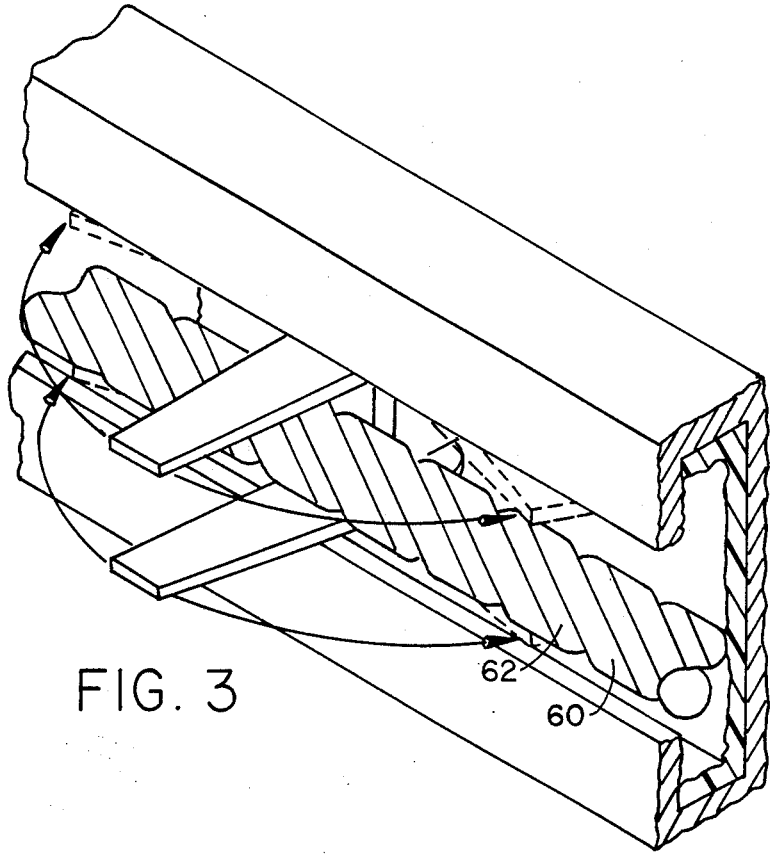
FIG. 3 is an enlarged perspective, partially fragmentary view of the helical drive member guide means.

Referring now particularly to FIGS. 2 and 3, each of the frame side and end members is seen to consist of an elongate metal or plastic member, the cross-section of which is in the general form of the letter "C" with a central substantially enclosed space extending along its complete length At intervals along the length of each member 14–20 there are provided openings 32 through the outer wall via which the members can be secured to an adjacent vertical wall surface via screws (not shown), for example. The corners of the end and side members are mitered as 34, for example, enabling the four sides to be fitted together into the desired rectangular frame with securement of mating ends being accomplished in any suitable manner (e.g., welding, clips).

A first rail 36 consisting of a generally elongated rectangular plate has one end of the pleated fabric 22 secured thereto in any satisfactory way and is, in turn, itself secured to the outer end member 14, for example, by threaded means 38. The opposite end of the pleated fabric is affixed to a movable rail 40 which can be identical to the first rail and has an overall length permitting sliding receipt between the inwardly facing surfaces of side members 16 and 20. Three sets of aligned openings are provided in the movable rail and in the various pleats of the pleated fabric forming three lines parallel to the side members 16 and 20, two of which are arranged closely adjacent the side members and the third being centrally located thereto. A cord 42 extends through the first set of openings closely adjacent the side member 16, a further cord 44 passes along the central set of aligned openings and a final cord 46 passes through the aligned openings adjacent side member 20. Each end of the cords 42–46 is secured to a separate block 48 positioned against the inner wall of each end member and secured thereto by a threaded member 50, for example. Four masking plates 52, 54, 56 and 58 are secured to the inner wall surface of the side and end members, and are, respectively, mitered in order to form a continuous plate surface extending inwardly of each of the members 14–20. As will be more particularly described later, the masking plates are located just outwardly of the major surface of the pleated fabric and inwardly of the outermost edges of the fabric in order to prevent light coming through the skylight being seen at the lateral edges.

The drive means for the removable rail 40 and the pleated fabric connected thereto consists of a length of cylindrical rod 60 having its outer surface configured into a continuous helical groove 62. One end of the drive rod 60 is journaled into a conventional mounting affixed to the inner surface of the end member 18 at a point just outwardly of the inner surface of side member 20. The opposite end of the drive rod is rotatably affixed to a conventional 90° gear housing 64 secured to the side members 20 and 14 adjacent their meeting point. When the drive rod is so mounted it lies just outwardly of the inner surface of side member 20 and can be rotated about its longitudinal axis upon manipulative driving of the gears in the gear box 64. As shown best in FIG. 1, the input power point of the gear box 64 is the female member 28 which mates with the end of the wand 26 such that rotative power applied to the wand passes the rotative power through the 90° gear box to effect rotation of the drive rod 60.

Figure 4:
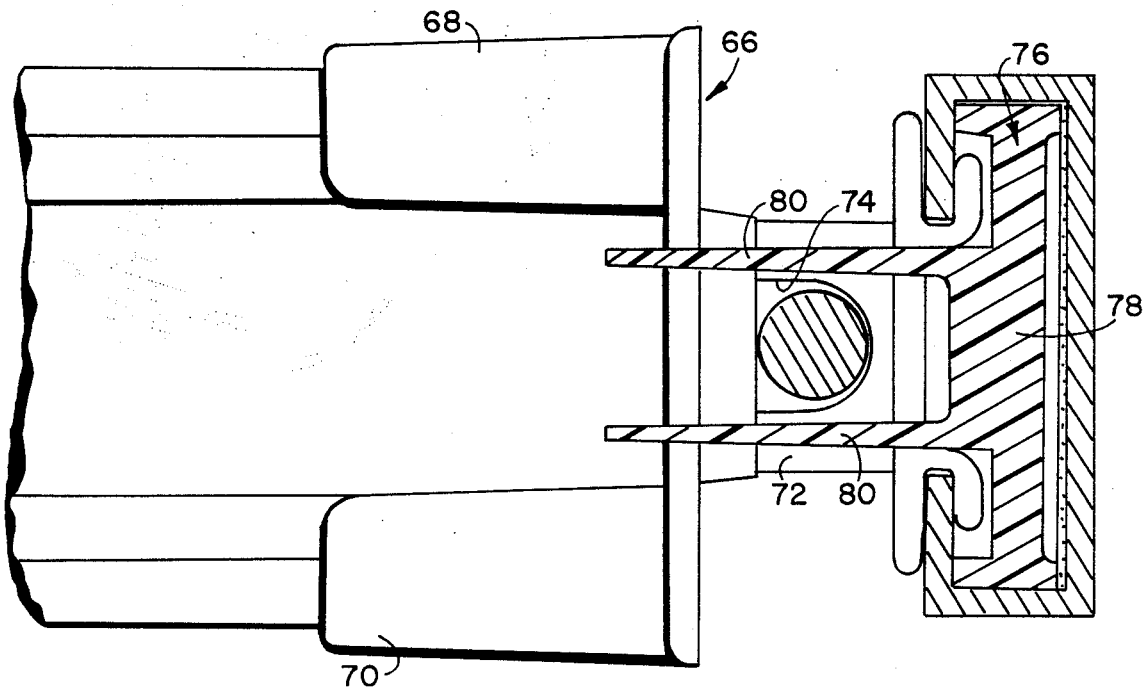
FIG. 4 is a side elevational, sectional view taken along line 4—4 of FIG. 3.

A drive nut 66 has a pair of spaced apart arms 68, 70 removably snapped onto the end of the movable rail 40. As can be seen best in FIG. 4, the drive nut also includes a portion 72 with an opening 74 through which the drive rod 60 passes. Internal walls of the drive nut opening 74 are configured so as to cooperate with the groove 62 on the drive rod 60 such that rotation of the drive rod causes the drive nut to move and thus reposition the movable rail 40 and pleated fabric.

In view of the fact that the window covering unit described here is for covering a ceiling wall, the natural effect of gravity will tend to pull the pleated fabric and the rail 66 downwardly and bow the drive rod 60. Of course, if this were permitted to take place the window covering would be aesthetically displeasing. Accordingly, there are provided one or more rod supports 76 mounted within the internal space of side member 20. More particularly, as shown best in FIG. 4, each rod support consists of a molded plastic member having a base 78 which fits snugly within the space within the side member and extending normally from the side of the base through the central slot in the inner side member are a pair of support arms 80, one on each side of the drive rod (FIG. 3). The arms are highly flexible such that as the drive nut 66 is moved therepast the arms will be moved toward the side member 20 (FIG. 3) to the position of the dotted line allowing the drive nut to move therepast After the nut has passed the rod support 76, the arms spring outwardly once more. This compressing movement of the arms to an out-of-the-way position result again when the drive nut is moved in the reverse direction past the rod support. Accordingly, at all times the drive rod is maintained in a substantially horizontal position through the action of the one or more supports 76.

With reference now to FIG. 2, the wand 26 can be of conventional construction having a transverse midportion or lever arm portion between two handle grips enabling rotation of the wand from one end to effect the rotative driving force desired. Alternatively, it is contemplated that instead of rotating the wand by hand, that, instead, a battery powered motor 82 can be affixed to the lower end and through an internal flexible shaft the wand end can be rotated in either direction depending upon the drive setting to effect positioning of the window covering unit.

Figure 5:
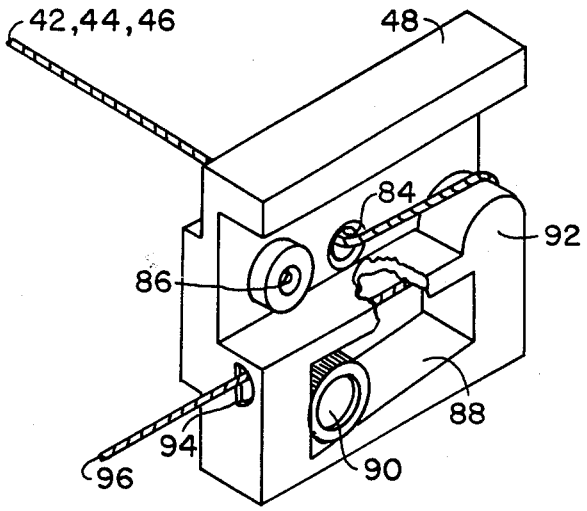
FIG. 5 is a perspective view of a cord tensioning device used in the invention.

FIG. 5 shows the opposite side of a tensioning block 48 from that depicted in FIG. 2. The block is generally rectangular with a central opening 84 and a further eccentrically located opening 86 via which a threaded means (not shown) passes for securing the block to the window covering frame. A tapering dished out portion 88 has a roller 90 received therein, free to roll at one end and locked at the opposite end of portion 88. A cord 42, 44 or 46 passes through opening 84 around a wall defining dished out portion 88, and through openings 92 and 94. When the cord is pulled taut it, in turn, pulls the roller 90 toward the narrow end of 88 wedging or locking the cord in place. Initial or any other adjustment to tighten the cord and prevent the window covering from sagging is accomplished by merely pulling on the cord end 96.

Figure 6A:
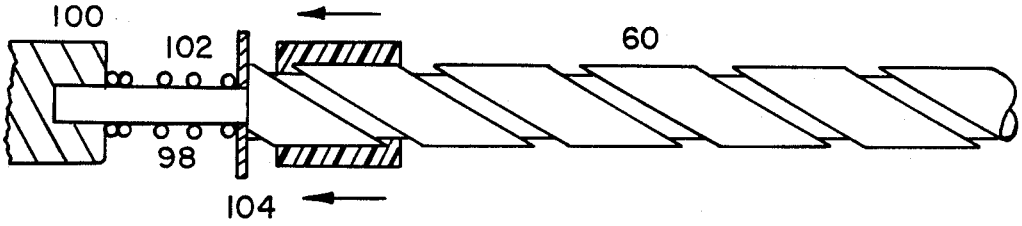
FIGS. 6A and 6B show the nut and drive shaft relation during normal drive and during slip drive at an extremity.
Figure 6B:
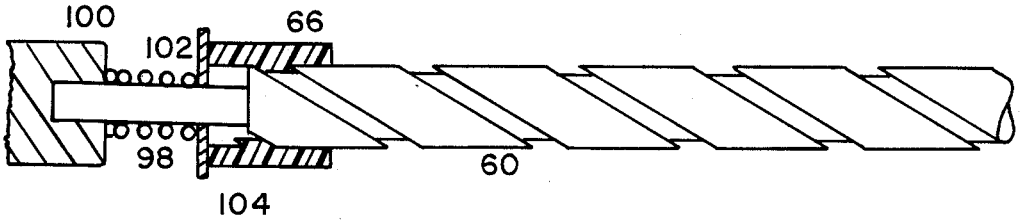

A further advantageous aspect of the described invention is that when the rail 40 is driven to its limit where the window covering encloses the entire frame space, further driving of the rod 60 merely produces slippage and does not further induce strain in the drive rod, nut 66 or other parts that might cause them to break or become damaged. As shown in FIG. 6A, the journaled end of the drive rod 60 has a turned-down, smooth-surfaced circular end portion 98 which is rotatively secured in a block 100. A coil spring 102 received on the portion 98 exerts a resilient force between the block 00 and a washer 104. On the nut 66 being driven to its extremity it reaches the position where it is disengaged from driving relation with the rod (FIG. 6B). Attempted further drive in the same direction merely slips the drive rod within the nut. However, since the spring 98 forces the nut toward the drive rod by means of the washer 104, when the rod is rotated in a direction to move the nut oppositely (i.e., open the window covering) the nut immediately drivingly engages with the rod.

What is claimed is:

1. A skylight window covering unit comprising:

a frame having two opposite ends and two opposite sides enclosing an open central portion;

a length of pleated fabric;

a first rail secured to one end of the pleated fabric and mounted on one frame end facing the frame open central portion;

a second rail secured to an opposite end of the pleated fabric and having its end portions slidingly related, respectively, to the frame sides;

a gear box mounted within a frame corner and having rotative power input means;

a drive rod having one end drivingly related with the gear box and its other end rotatably journaled in an opposite corner of the frame so that the rod is generally parallel and closely adjacent to one frame side, said rod having a helical groove on its outer surface; and nut means mounted onto an end of the second rail receives the drive rod therein and is moved along the rod by rotation thereof.

2. A skylight window covering unit as in claim 1, in which a drive rod support means is provided including first and second resilient arms extending above and below the drive rod, respectively.

3. A skylight window covering unit as in claim 1, in which a wand having an appropriately formed receipt within the gear box rotative power input means, rotation of the wand end thereby rotating the drive rod via the gear box.

4. A skylight window covering unit as in claim 3, in which a handheld battery driven motor rotates the wand end.

5. A skylight window covering unit as in claim 1, in which a plurality of sets of aligned openings are provided in the pleated fabric, each set defining a straight line extending from one frame end toward the other; a cord is threaded through each set of aligned openings and the cord ends being secured in the region of the frame ends.

6. A skylight window covering unit as in claim 5, in which a tensioning block is mounted in the frame end for each cord, each such tensioning block including roller means for adjustable sliding locking engagement of a cord.

7. A skylight window covering unit as in claim 6, in said tensioning block includes a centrally located opening on one surface for receiving a cord therein, block walls defining a transversely extending tapered passage on said second surface, and a roller in said passage for lockingly engaging a cord between the roller and a block wall defining said passage.

8. A skylight window covering unit as in claim 1, in which the drive rod has its other end portion reduced to a smooth uniform diameter portion free of the helical groove that slides within the nut when the nut is drivingly threaded off the rod, and a spring engaging the nut when it is located on the rod uniform diameter portion urging the nut back onto the rod.

* * * * *